US007360330B2

(12) United States Patent
Abrams

(10) Patent No.: US 7,360,330 B2
(45) Date of Patent: Apr. 22, 2008

(54) MULTI-PURPOSE DISPLAY FRAME WITH GRAVITY LOCK

(76) Inventor: Charles Abrams, 10 Buckminster Rd., Rockville Centre, NY (US) 11570

( * ) Notice: Subject to any disclaimer, the term of this patent is extended or adjusted under 35 U.S.C. 154(b) by 495 days.

(21) Appl. No.: 11/037,594

(22) Filed: Jan. 18, 2005

(65) Prior Publication Data

US 2006/0156605 A1 Jul. 20, 2006

(51) Int. Cl.
*A47G 1/06* (2006.01)

(52) U.S. Cl. ..... 40/712; 40/779; 292/156; 292/183

(58) Field of Classification Search ..... 40/712, 40/779, 201, 209; 292/137, 156, 183
See application file for complete search history.

(56) References Cited

U.S. PATENT DOCUMENTS 190,068 A * 4/1877 Odenbaugh ..... 40/732
223,624 A * 1/1880 De Witt ..... 292/57
3,589,049 A * 6/1971 Cornelius ..... 40/722
5,283,967 A * 2/1994 Abrams ..... 40/779
6,135,511 A * 10/2000 Smith et al. ..... 292/156
6,438,883 B1 * 8/2002 Kacius ..... 40/735

* cited by examiner

*Primary Examiner*—Gary C Hoge
(74) *Attorney, Agent, or Firm*—Galgano & Associates, PLLC

(57) ABSTRACT

A multi-purpose, front-loading display frame includes a front frame member having a pair of opposite first and second lateral side sections, a rear frame member having a pair of opposite first and second lateral side sections, at least one hinge for pivotally joining the first lateral side section of the front member to the first side section of the rear frame member to permit pivotal movement between an open position, in which the second side sections of the front and rear frame members may be pivoted apart from one another, and a closed position, in which the second side sections are disposed closely adjacent to one another. A lock is mounted on one of the second side sections of one of the front and rear frame members, and at least one latch plate is engageable with the lock. The latch plate is mounted on the other of the second side sections of the other of the front and rear frame members for cooperative engagement with the lock. One of the lock and the latch plate is fixed and the other is generally vertically reciprocable so that, when the front frame member and the rear frame members are in the closed position, one of the lock and latch plate is reciprocably moveable relative to the other for movement between a normally locked and a release position, respectively.

11 Claims, 5 Drawing Sheets

MULTI-PURPOSE DISPLAY FRAME WITH GRAVITY LOCK

BACKGROUND OF THE INVENTION

1. Field of the Invention

The present invention relates to a multi-purpose display frame. More particularly, it relates to a swing-open, front loading wall display frame for displaying printed materials, such as posters, publications, artwork, photographs, documents, and other graphic art items, dimensional objects, and collectibles.

2. Brief Description of the Prior Art

Various picture, poster and other multi-purpose frames are available for displaying a wide variety of printed graphic art material. See, for example U.S. Pat. No. 4,822,195, to Lu; U.S. Pat. No. 5,018,291, to Pasquale et al; and U.S. Pat. No. 4,984,798, to Silberstein. In particular, U.S. Pat. No. 4,446,206, to Meadows, discloses a picture frame which includes a substantially flat transparent window surrounded by a frame member which, in turn, is hingeably secured to a substantially flat closure back panel holding the intended graphic against the transparent window when the closure back panel is in a closed position. A combination latch and hanger member is provided for hanging the frame and maintaining the front and back panels in a closed position, and the device preferably includes a plurality of compression pads which press against the graphic when the closure back panel is in the closed position. However, to change the picture, one most remove the frame from the wall to enable one to open the latch, swing open the back flap, and remove and replace the old picture. This procedure occurs every time the art work needs to be inserted, removed or replaced. In addition, the top portion of the latch protrudes above the frame which is aesthetically unacceptable.

U.S. Pat. No. 4,958,458, to Hillstrom et al., discloses a poster display frame fastened via conventional means to a rigid supporting member such as posts, walls or the like. The sides of the Hillstrom frame comprise sets of both front and back frame members which are interconnected and pivotably engaged and made from extruded metal or molded plastic. A spring member is necessary to bias the front and back frame members into mating pivotal engagement and bias the front frame members against the poster and backing frame member when the frame sections are closed, as well to hold the front frame members in their open positions. This frame requires complicated fabrication/molding of the frame members and hinge assembly. The Hillstrom frame requires a rather complicated cylindrical hinge or pivot pintle formation on the back of the back frame member and a corresponding cup-shaped socket portion formed on the back panel of the front frame member. The two are joined either slidably or snapped together. The Hillstrom device also cannot use conventional industry standard metal picture frame extrusions.

U.S. Pat. No. 4,947,565, to Shadwell, discloses a picture framing assembly which includes a rectangular picture frame that can be opened and closed repeatedly for mounting and changing the picture to be displayed in the frame. The picture framing device is characterized by a rigid backing sheet which is hinge mounted along one edge of the frame and releasably secured to the frame along the other three edges with adhesive tape. The device has a backing sheet having an adhesive strip on the surface of the mat facing the backing sheet for releasably securing the picture to the mat. Here, too, like Meadows, the picture frame must be removed from the wall to allow for the opening and closing of the backing sheet. In addition, the backing sheet is hinged by tape which is also taped around the other edges of the frame. Slight finger pressure must be used in an opening in the corner of the backing sheet to release the backing sheet and provide access to the recessed cross-section of the frame to enable one to insert, remove, or replace the picture. The picture frame is re-sealed by re-securing the tape all around the back of the frame. This does not permit ready access and is time consuming.

U.S. Pat. No. 4,756,108, to Lackay et al, discloses a display frame for displaying posters, advertisements and other printed matter which has a rectangular front frame which supports a transparent window which, in turn, is hingeably mounted at its bottom to a vertical solid face via vertical support modules. The vertical solid face includes a compressible backing for holding display material in place behind the window which must be removed when replacing the picture. The device also requires a rather complicated hinge and clamping device.

In summary, each of the frames has substantial disadvantages. Some are rather complicated in construction, and others are difficult to use to effect replacement of the display item. Furthermore, others do not afford sufficient protection and ease of use for framing collectibles in a non-damaging manner, which is important for maintaining the value of the printed graphic such as comic books, cartoon cells, baseball cards, and the like.

My prior U.S. Pat. No. 5,283,967 discloses a multi-purpose display frame which includes a front frame member having a window section for viewing a display item disposed behind it and a rear frame member having a front surface for releasably supporting at least one interchangeable display item. The frame also includes hinge means for hingeably securing the front frame member to the rear frame member so as to allow for pivotable movement of the frame members between a closed position, in which the frame members are disposed closely adjacent to one another so that a display item supported on the rear frame member is disposed behind the window section for viewing, and an open position, in which the frame members are pivoted apart from one another to permit removal and replacement of the display item. Closure means is also provided and is mounted on at least one of the front and rear frame members for releasably maintaining the front and rear frame members in the closed position. The closure means is positioned so as to allow the front frame to swing outwardly via pivoting movement into the open position, while the rear frame member is secured on a support.

The hinge means comprises a piano-type hinge. The closure means comprises a frictionally releasable spring latch. The front frame member sections preferably have a channeled rear surface, and the piano-type hinge has a U-shaped leaf securely received in the rear surface channel of the front frame member and an L-shaped leaf secured to a frame section of the rear frame member. The display frame additionally includes an L-shaped bracket, one leg of which is securable to a wall and the other leg of which is securable to the rear frame member, for mounting the frame on a wall. In the disclosed embodiment, the bracket must be attached to the wall first and then to the frame. The latch allows the frame to be opened easily with a slight tug. However, the latch can be bent out of shape so that it no longer functions properly.

SUMMARY OF THE INVENTION

It is therefore an object of the invention to provide a multi-purpose display frame which is relatively simple in design, easy to use and economical to fabricate.

It is also an object of the invention to provide a multi-purpose display frame which can be used to frame items in a safe, yet accessible, manner by providing a swing-open, front-loading, wall-mounted display frame.

It is another object of the invention to provide a multi-purpose display frame which improves on my prior frame, e.g., by providing a normally concealed, manually releasable gravity-actuated lock.

Certain of the foregoing and related objects are readily attained according to the present invention by the provision of a multi-purpose, front-loading display frame, comprising a front frame member having a pair of opposite first and second lateral side sections, a rear frame member having a pair of opposite first and second lateral side sections, at least one hinge for pivotally joining said first lateral side section of said front member to said first side section of said rear frame member to permit pivotal movement between an open position, in which the second side sections of said front and rear frame members may be pivoted apart from one another, and a closed position, in which said second side sections are disposed closely adjacent to one another, a lock mounted on one of said second side sections of one of said front and rear frame members, and at least one latch plate engageable with said lock. The latch plate is mounted on the other of said second side sections of the other of said front and rear frame members for cooperative engagement with said lock, with one of said lock and said latch plate being fixed and the other being generally vertically reciprocable so that, when said front frame member and said rear frame members are in said closed position, one of said lock and latch plate is movable relative to the other for movement between a normally locked and release position, respectively.

Preferably, the lock is slidably mounted on said second side section of said front frame member for generally vertically reciprocable movement between a raised upper release position and a lower locked position, and said latch plate is fixedly mounted on said second side section of said rear frame members. The lock is manually movable to said raised upper release position and is movable, solely via gravity, to said lower locked position.

Desirably, the second side section of said front frame member has a rear surface and a generally vertically-disposed, U-shaped, rearwardly opening channel with an interior track which channel is disposed adjacent to the rear surface thereof. Advantageously, the lock comprises an elongated flat bar having at least one raised downward depending and opening finger, said lock being received with said track of said channel.

In a preferred embodiment, the lock has a plurality of spaced-apart, raised downwardly depending fingers and a pair of said latch plates are provided which are mounted on a lateral edge of said second side section of said rear frame member. Means are also for mounting said rear frame member on a surface. The front and rear frame members are preferably made of material selected from the group consisting of metal, plastic, wood and a combination thereof. Most desirably, one of said fingers is covered with a cap which serves as a finger grip. Most advantageously, a pair of hinges are provided which are positioned in a spaced-apart manner. The latch plates are generally L-shaped, and a pair of spaced-apart stops are mounted in said track of said channel in which the lock is movably mounted to limit reciprocable movement of said lock.

In a particularly preferred embodiment of the invention, the second side section of said rear frame member has an outer edge, said L-shaped latch plates each have a leg extending laterally outwardly from generally the middle of said outer edge, and the rear frame nests partially within said front frame.

DETAILED DESCRIPTION

Figure 1:
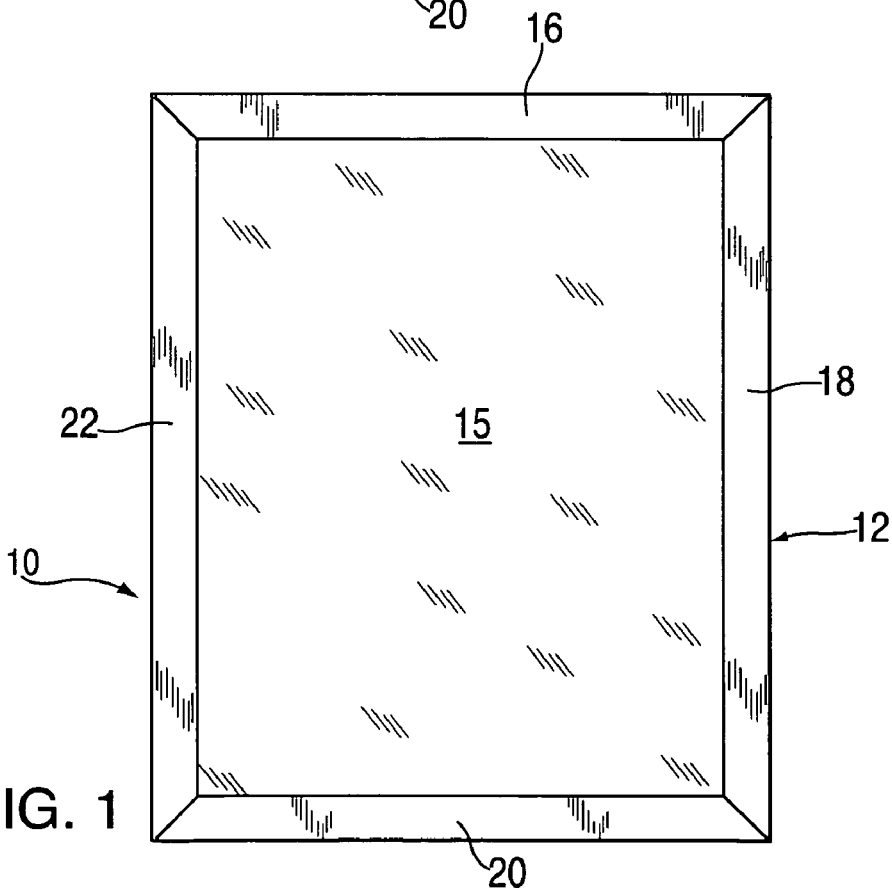
FIG. 1 is a front view of a first embodiment of the invention.
Figure 3:
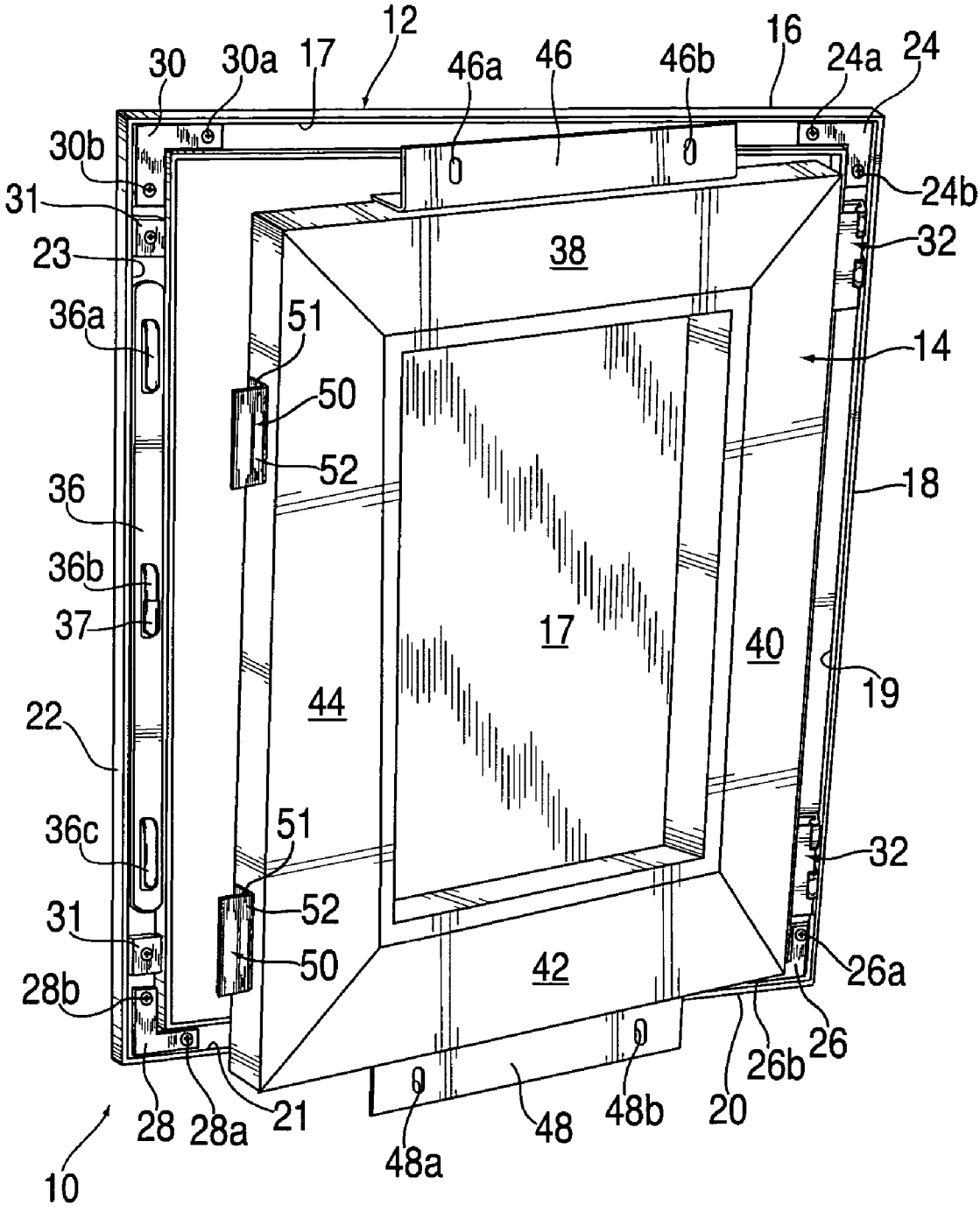
FIG. 3 is a rear perspective view of the first embodiment in a partially open configuration.

Referring now to FIGS. 1 and 3, a first embodiment of a multi-purpose display frame 10 according to the invention includes a preferably generally rectangular front frame member 12 which supports and surrounds a transparent glass or plastic panel 15 and a rear frame member 14 which supports a generally rectangular panel 17 the front of which is, in turn, intended to support the item to be displayed (not shown).

The front frame member 12 is a mitered metal frame comprised of four pieces of metal 16, 20, 22, 24 which, as seen best in FIG. 3, has four rearwardly opening generally right angle U-shaped channel members 17, 19, 21, 23 incorporated into its rear surface. The free ends of the U-shaped channel members have inwardly-directed flanges 29 (see FIG. 6) which lie flush with the rear surface of the frame member 12 and which define a track therebelow for insertion and retention of additional frame parts within the right angled U-shaped channel. More particularly, the channel members 17, 19, 21, 23 are coupled to each other with right angle brackets 24, 26, 28, and 30. Each of the right angle brackets 24, 26, 28, and 30 is received within the tracks defined by adjacent U-shaped channels and are affixed to adjacent channel members by two screws 24*a*, 24*b*, 26*a*, 26*b*, 28*a*, 28*b*, 30*a*, 30*b*, respectively. A pair of hinges 32 are disposed in the track of the channel 19 for hingeably and pivotably joining the front frame member 12 and the rear frame member 14 along one side to permit movement of the frame members 12, 14 between an open and closed position, as discussed in detail hereinafter.

A manually releasable, slidable, gravity-actuated lock or latch 36 is disposed in channel 23. The gravity lock 36 is a preferably metal, flat rod that is punched and bent to define preferably three spaced-apart, raised, rearwardly projecting and downward depending and opening hooks or fingers 36*a*, 36*b*, and 36*c*. It should be appreciated that the gravity lock 36 is free to slide up and down in the track of channel 23, its movement limited only by a pair of rectangular stops 31 fixed in position in the track of channel 23 via a screw.

The rear frame member 14 is preferably made from four pieces of wood 38, 40, 42, 44 which are mitered together in a conventional manner using fasteners and/or adhesive (not shown). The top piece 38 and the bottom piece 42 are provided with generally L-shaped metal mounting brackets 46 and 48, respectively. The brackets 46, 48 each have an upstanding or downwardly depending leg, respectively, defining at least one, and preferably, a pair of mounting holes 46*a*, 46*b* and 48*a*, 48*b*, respectively, through which the rear frame member 14 is mounted on a surface such as a wall using, e.g., screws (not shown).

Rear frame member side piece 40 is coupled to the hinges 32 as described in more detail below with reference to FIG. 6. The opposite side piece 44 is preferably provided on its outer lateral edge with a latch or lock-engaging pair of spaced-apart, L-shaped latch plates 50. One leg 51 of each of the lock engaging latch plates 50 is fixed to the edge of side piece 44 of rear frame 14 and its other leg 52 serves as a latch plate which is engageable by one of the hook-shaped fingers 36*a* and 36*c* of the gravity lock 36. Operation of the lock and the bracket (which is the same for both embodiments) will be described in detail below with reference to the second embodiment in FIGS. 2, 4, and 5. Preferably, the gravity lock 36 includes a middle hook-shaped finger 36*b* covered with a plastic cap 37, which does not engage a corresponding latch plate, but simply serves as a convenient and comfortable, yet hidden, latch grip or handle for the user to lift and release the gravity lock 36.

Other aspects of the display frame such as matting, padding, adhesives, glass, etc. are substantially the same as described in my prior U.S. Pat. No. 5,283,967, the complete disclosure of which is hereby incorporated herein by reference.

Figure 2:
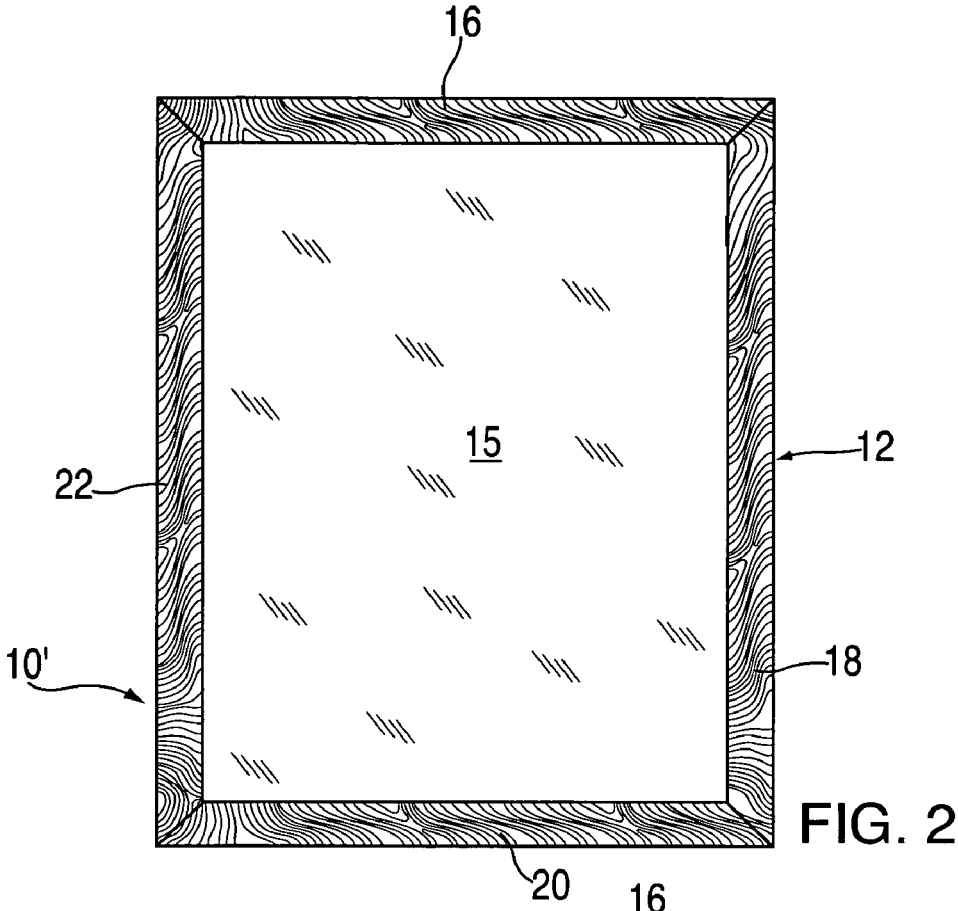
FIG. 2 is a front view of a second embodiment of the invention.
Figure 4:
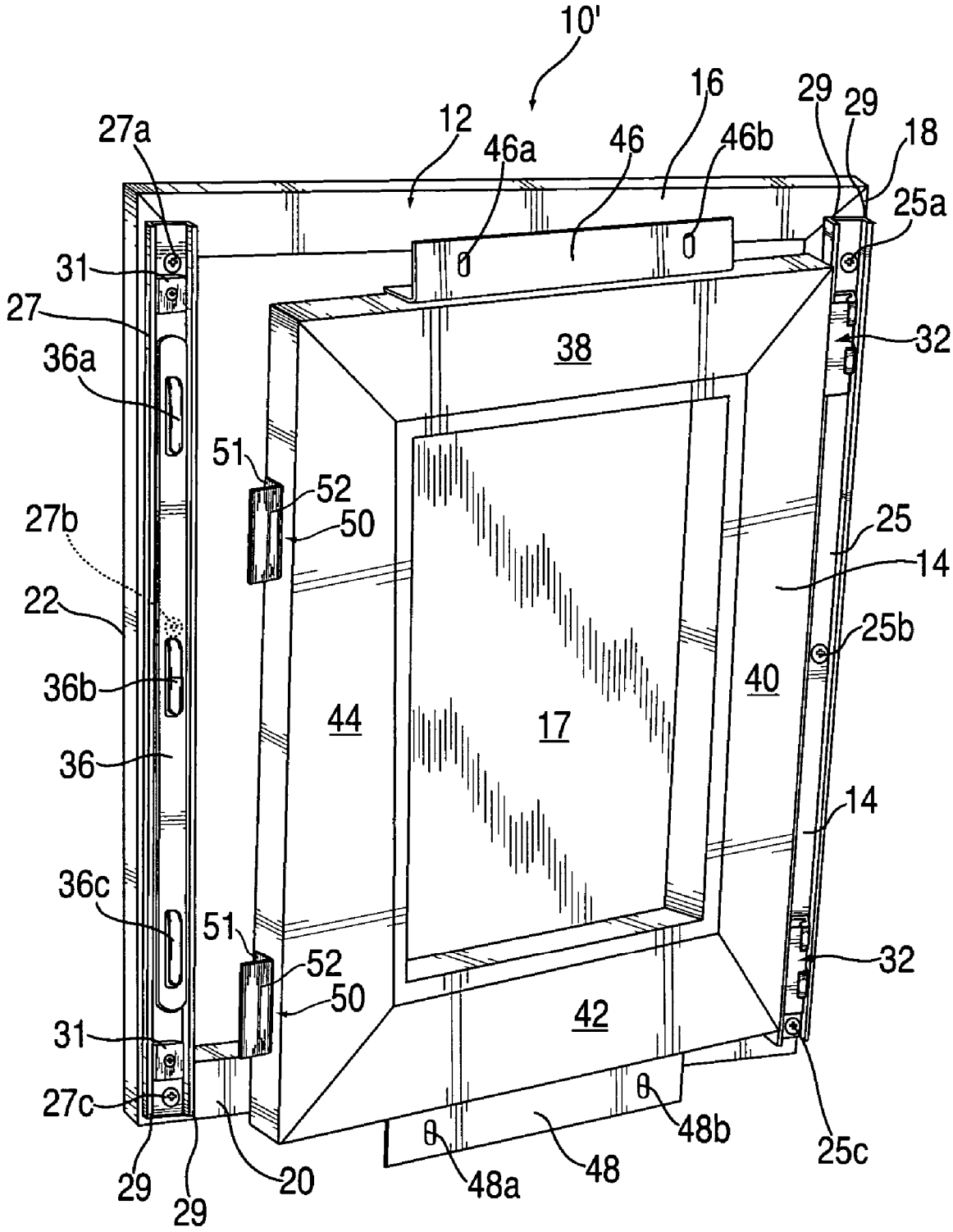
FIG. 4 is a rear perspective view of the second embodiment in a partially open configuration.

Referring now to FIGS. 2 and 4, a second embodiment of a multi-purpose display frame 10' according to the invention is illustrated (the same or equivalent parts are referenced by the same reference numerals). Frame 10' includes a preferably rectangular front frame member 12 which supports and surrounds a transparent glass or plastic panel 15 and a rear frame member 14 which supports a generally rectangular panel 17, the front face of which is, in turn, intended to support the item to be displayed (not shown).

The front frame member 12 is a mitered wood frame which is composed of four members 16, 18, 20, 22. These members are coupled to each other in a conventional manner using fasteners and/or adhesive (not shown). Each of the side members 18, 22 is provided with a metal U-shaped channel member 25, 27 respectively having right angle U-shaped channels (not shown) with a low profile; they could instead by embedded in the rear surface of frame members 18, 22. Here too, the free ends of right angled U-shaped channel members 25, 27 have inwardly-directed flanges 29 (shown best in FIG. 6) which define a track in the channel therebelow for insertion and retention of additional frame parts. Each channel member 25, 27 is affixed to the rear surface of respective wood frame members by screws 25*a*, 25*b*, 25*c*, and 27*a*, 27*b*, 27*c*.

A pair of spaced-apart hinges 32 are disposed in the track of channel member 25. A sliding gravity lock or latch 36 is disposed in the channel 27. The hinges 32 are coupled to the channel 25 as described in more detail below with reference to FIG. 6. The gravity lock 36 is a preferably flat metal rod that is punched and bent to define three raised and downward depending and opening fingers 36*a*, 36*b*, and 36*c*. It should be appreciated that the gravity lock 36 is free to slide up and down in the track of channel 27. In order to prevent the lock 36 from escaping the track of the channel 27, a pair of rectangular metal stop blocks 31 are fixed in position in the track of channel 25 by screws and they are positioned to limit the reciprocal movement of the gravity lock 36 between a release or "up" position, in which the gravity lock is manually raised via finger grip 36*b* so that fingers 36*a* and 36*c* are disposed above the latch plates 50, and a normally locked or "down" position, in which the finger grip 36*b* is released to permit it and the gravity lock 36 to fall under gravity so that fingers 36*a* and 36*c* are each disposed over a respective latch plate 50, thereby locking the front and rear frames 12, 14 together.

The rear frame member 14 is preferably made from four pieces of wood 38, 40, 42, 44 which are mitered together in a conventional manner using fasteners and/or adhesive (not shown). The top piece 38 and the bottom piece 42 are provided with mounting brackets 46 and 48, respectively. The brackets each have a rear face defining at least one pair of mounting holes and preferably 46*a*, 46*b* and 48*a*, 48*b*, respectively, through which the rear frame member 14 is mounted on a surface such as a wall using screws (not shown). Rear frame member side piece 40 is coupled to the pair of spaced-apart hinges 32 as described in more detail below with reference to FIG. 6. The opposite side piece 44 is provided with a pair of spaced-apart, latch or lock engaging L-shaped latching plates 50. The L-shaped lock engaging latch plates 50 each has a leg 51 attached to the lateral edge of frame member 44 and a leg 52 which is engageable by one of the fingers 36*a* and 36*b* of the gravity lock 36, as in the other embodiment. Other aspects of the display frame such as matting, padding, adhesives, glass, etc. are substantially the same as described in my previously incorporated prior U.S. patent.

Figure 5:
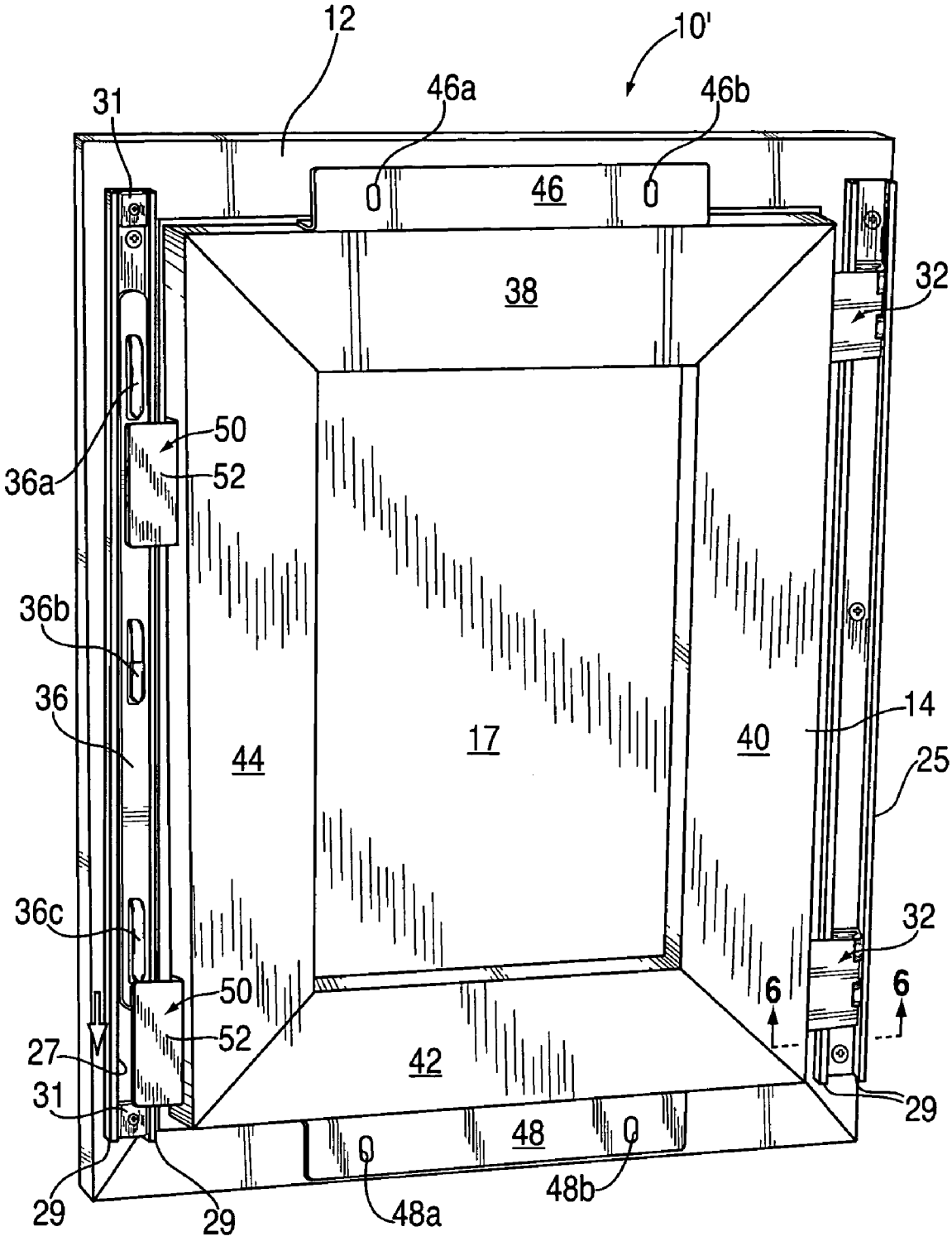
FIG. 5 is a rear perspective view of the second embodiment in a closed position, prior to locking.

From the foregoing, and by comparing FIGS. 4 and 5, operation of the gravity lock will be understood. In the closed position shown in FIG. 5, the display frame 10 is opened by the user reaching behind the front frame member 12 and manually lifting the finger 36*b* of the gravity lock 36 with his or her finger. This releases the fingers 36*a* and 36*c* from the lock engaging latch plate 50 and allows the front frame member 12 to swing open (FIG. 4) relative to rear frame member 14 about hinges 32. After the display item has been placed on/in the panel 17 of the rear frame member (as described in my previously incorporated prior U.S. patent), the finger 36*b* is manually lifted again, the front frame member 12 is swung back to the closed position and the finger 36*b* is released while holding the front frame member 12 against the rear frame member 14. As a result, the gravity lock 36 drops solely under gravity and engages with the fingers 36*a*, 36*c* each engaging one of the legs 52 of latch plates 50, thereby locking the frame 10' in its closed position.

It will be appreciated that operation of the first embodiment is exactly the same as described with reference to the second embodiment. In both embodiments, the rear frame 14 is made slightly smaller than the front frame 12 so that, when the frames are in the closed position, the rear frame 14 partially nests with the front frame. This is dictated by the positioning of the L-shaped lateral plates 50, such that leg 52 thereof is disposed between the edges of, and preferably generally in the middle of the outer side edge of side piece 144. This arrangement creates a space behind the front frame 12, 12' to allow for the function of the gravity lock and to permit one to insert his or her finger behind the front frame 12, 12' to reach the finger grip 36*b* when the rear frame 14 is mounted on a wall (not shown).

Figure 6:
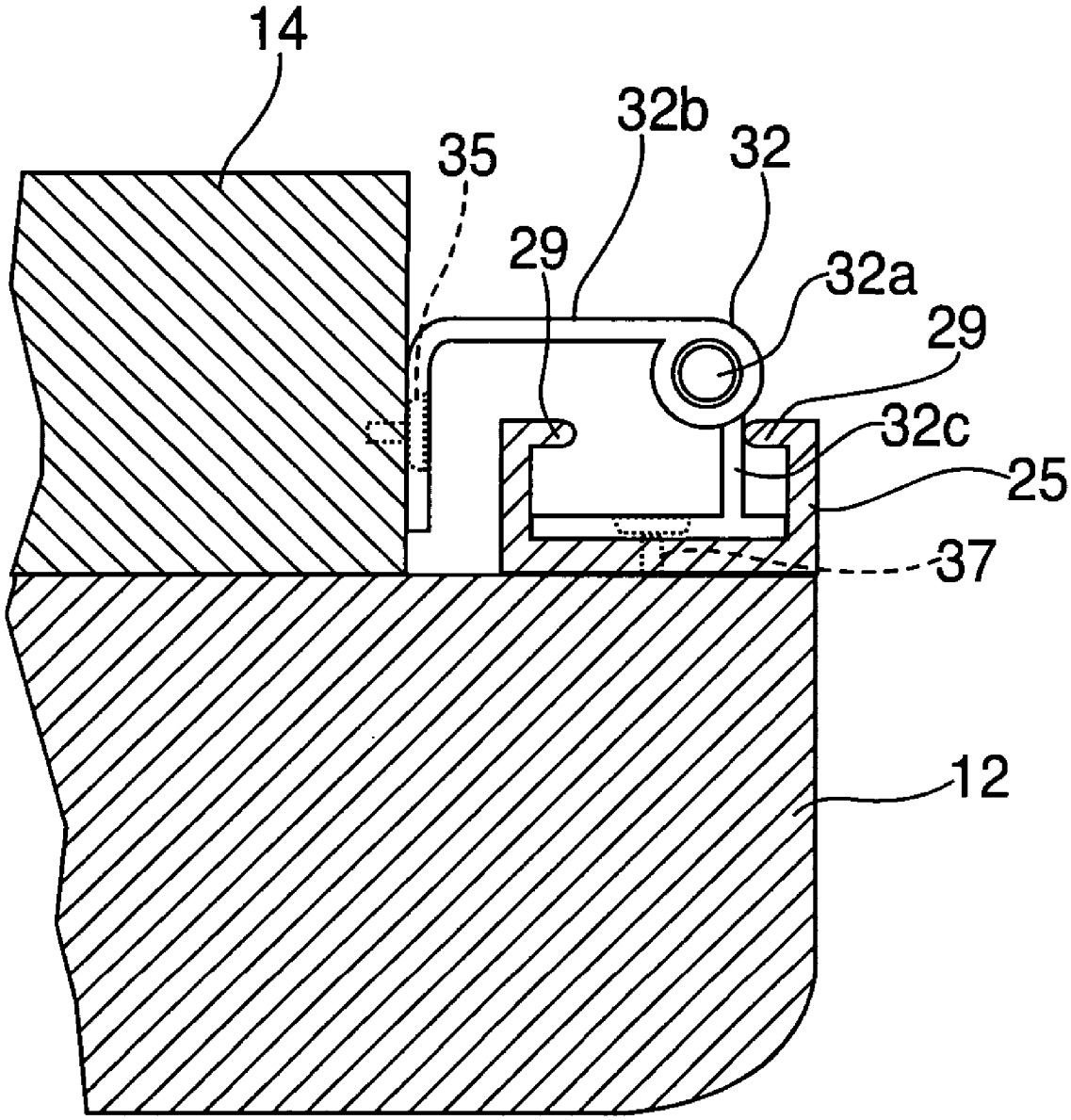
FIG. 6 is a section taken along line 6-6 in FIG. 5.

FIG. 6 illustrates how each of the hinges 32 fits into the channel 25 and attaches to the frame member 14. The hinge 32 includes a hinge pin 32*a*, an L-shaped half 32*b* and a somewhat T-shaped half 32*c*. The L-shaped half 32*b* is designed to be coupled to the outer side edge of the rear frame member 14 with a screw 35. The T-shaped half 34*c* is designed to fit comfortably in the track of channel 25 and be secured to the channel (and/or through it) with screw 37.

The gravity lock of the present invention is a significant improvement over the friction lock of my prior design. It is not likely to be bent out of operational shape. The locked frame is not able to be accidentally opened by someone touching the frame. The gravity lock is hidden and not readily viewable. As a result, the location of the gravity lock is unknown to the casual observer who therefore doesn't realize the frame is openable. The new location and orientation of the mounting brackets allow the frame to be mounted more quickly and easily than my prior design.

There have been described and illustrated herein different embodiments of a multi-purpose display frame. While particular embodiments of the invention have been described, it is not intended that the invention be limited thereto, as it is intended that the invention be as broad in scope as the art will allow and that the specification be read likewise. For example, the present invention can be made from any frame which has side channels or which can be provided with side channels. In addition, depending on the size of the frame, the rear frame member may be made of metal or possibly plastic instead of wood. The length and number of the gravity locks and the number of fingers and latch plates can be modified as desired to suit a particular application. Moreover, the respective positions of the gravity lock and latch plate assembly could possibly be reversed provided sufficient space is provided to enable the user to reach behind the front frame to reach the gravity lock or latch. Similarly, the latch plates could be vertically reciprocally movable and the gravity lock fixed in an upside down manner so long as the manner of opening remains essentially the same. It will therefore be appreciated by those skilled in the art that yet other modifications could be made to the provided invention without deviating from its spirit and scope as so claimed.

What is claimed is:

1. A multi-purpose, front-loading display frame, comprising:

a front frame member having a pair of opposite first and second lateral side sections, wherein said second side section of said front frame member has a rear surface and a generally vertically-disposed, U-shaped, rearwardlv opening channel with an interior track which channel is disposed adjacent to and opens onto the rear surface thereof;

a rear frame member having a pair of opposite first and second lateral side sections;

at least one hinge for pivotally joining said first lateral side section of said front member to said first side section of said rear frame member to permit pivotal movement between an open position, in which the second side sections of said front and rear frame members may be pivoted apart from one another, and a closed position, in which said second side sections are disposed closely adjacent to one another;

a lock slidably mounted on said second side section of said front frame member for generally vertically reciprocable movement between a raised upper release position and a lower locked position, said lock comprising an elongated flat bar having at least one raised downward depending and opening finger, said lock being received with said track of said channel; and at least one latch plate engageable with said lock, said latch plate being fixedly mounted on said second side section of said rear frame member, for cooperative engagement with said lock, said lock being generally vertically reciprocable so that, when said front frame member and said rear frame members are in said closed position, said lock is manually movable relative to said latch plate for movement between a raised upper release position and being movably solely via gravity, to a lower locked position.

2. A frame according to claim 1, wherein a pair of spaced-apart stops are mounted in said track of said channel to limit reciprocable movement of said lock.

3. A frame according to claim 1, wherein:

said lock has a plurality of spaced-apart, raised downwardly depending fingers.

4. A frame according to claim 3, wherein a pair of said latch plates are provided which are spaced apart on said second side section.

5. A frame according to claim 3, wherein one of said fingers is covered with a cap which serves as a finger grip.

6. A frame according to claim 4, wherein said latch plates are generally L-shaped.

7. A frame according to claim 6, wherein said second side section of said rear frame member has an outer edge, and said L-shaped latch plates each have a leg extending laterally outwardly from generally the middle of said outer edge.

8. A frame according to claim 7, wherein said rear frame nests partially within said front frame.

9. A frame according to claim 1, additionally including means for mounting said rear frame member on a surface.

10. A frame according to claim 1, wherein said front and rear frame members are made of material selected from the group consisting of metal, plastic, wood and a combination thereof.

11. A frame according to claim 1, wherein a pair of hinges are provided which are positioned in a spaced-apart manner.

* * * * *